US010240300B2

(12) United States Patent
Lichtberger

(10) Patent No.: US 10,240,300 B2
(45) Date of Patent: Mar. 26, 2019

(54) TAMPING MACHINE FOR COMPACTING THE BALLAST BED OF A TRACK

(71) Applicant: System 7—Railsupport GmbH, Vienna (AT)

(72) Inventor: Bernhard Lichtberger, Pregarten (AT)

(73) Assignee: HP3 Real GmbH, Vienna (AT)

( * ) Notice: Subject to any disclaimer, the term of this patent is extended or adjusted under 35 U.S.C. 154(b) by 180 days.

(21) Appl. No.: 15/516,890

(22) PCT Filed: Oct. 6, 2015

(86) PCT No.: PCT/AT2015/050247

§ 371 (c)(1),
(2) Date: Apr. 4, 2017

(87) PCT Pub. No.: WO2016/054667

PCT Pub. Date: Apr. 14, 2016

(65) Prior Publication Data

US 2018/0274179 A1 Sep. 27, 2018

(30) Foreign Application Priority Data

Oct. 6, 2014 (AT) ..... A 50713/2014

(51) Int. Cl.
*E01B 27/17* (2006.01)

(52) U.S. Cl.
CPC ..... *E01B 27/17* (2013.01)

(58) Field of Classification Search
CPC .... E01B 27/16; E01B 27/17; E01B 2203/125; E01B 29/00
See application file for complete search history.

(56) References Cited

U.S. PATENT DOCUMENTS 4,576,095 A * 3/1986 Theurer ..... E01B 27/16 104/12
5,007,349 A 4/1991 Theurer
(Continued)

FOREIGN PATENT DOCUMENTS

EP 0455179 A3 11/1991
EP 0386398 B1 10/1992
(Continued)

OTHER PUBLICATIONS

English Abstract of JP H08-3903 A, published Jan. 9, 1996.

*Primary Examiner* — Mark T Le
(74) *Attorney, Agent, or Firm* — Tiajoloff & Kelly LLP

(57) ABSTRACT

A tamping machine for compacting the ballast bed of a track comprises at least two tamping units for each side of the tamping machine, which units can be displaced transversely relative to the longitudinal direction of the tamping machine by means of a transversal displacement device. At least two guides, in particular motion bars or sliding tubes are associated with both tamping units of each side of the tamping machine, said guides being offset in relation to one another with respect to their height and in the longitudinal direction of the tamping machine. Each outer tamping unit and its associated guides can be displaced transversely to the longitudinal direction of the tamping machine using an adjusting drive and the inner tamping unit can be displaced on the same guides, independently of the outer tamping unit, transversely to the longitudinal direction of the tamping machine using an adjusting drive.

13 Claims, 4 Drawing Sheets

(56) References Cited

U.S. PATENT DOCUMENTS

| | | | |
|---|---|---|---|
| 5,007,350 | A | 4/1991 | Theurer |
| 5,127,334 | A | 7/1992 | Theurer |
| 7,383,777 | B2 | 6/2008 | Theurer et al. |
| 2007/0283836 | A1 | 12/2007 | Theurer |

FOREIGN PATENT DOCUMENTS

| | | | |
|---|---|---|---|
| EP | 1846616 | B1 | 6/2008 |
| JP | H08-3903 | A | 1/1996 |

* cited by examiner

FIG.1
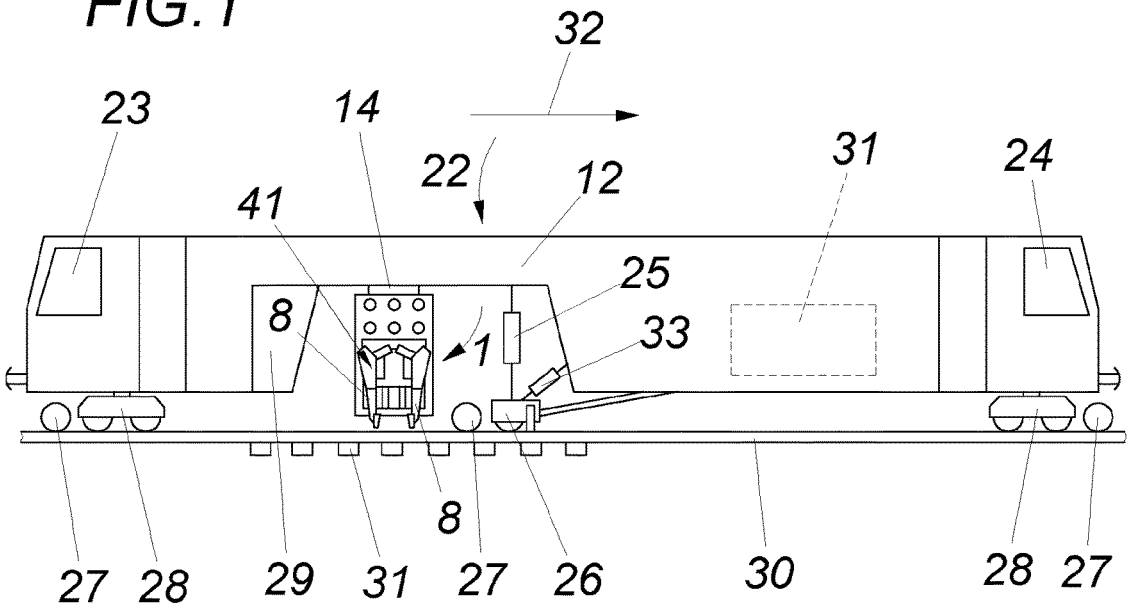
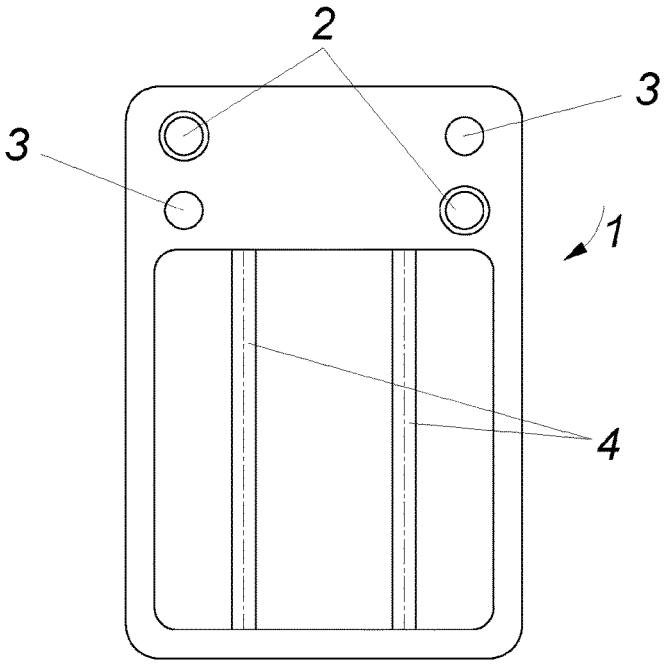
FIG.4

TAMPING MACHINE FOR COMPACTING THE BALLAST BED OF A TRACK

FIELD OF THE INVENTION

The invention relates to a tamping machine for compacting the ballast bed of a track, comprising at least two respective tamping units for each side of the tamping machine for tamping the track, which units can each be displaced transversely relative to the longitudinal direction of the tamping machine by means of a transverse displacement device, and comprising a lifting and lining device for levelling and lining the track and optionally the diverging track of a switch, said lifting and lining device being arranged between on-track undercarriages in the working direction preferably before the tamping units.

DESCRIPTION OF THE PRIOR ART

Tamping machines are machines which correct the track position of switches and/or tracks. Measurement systems are used for this purpose which compare the actual position of the track height, the actual position of the track direction and the actual position of the superelevation of the track during the work and which compare said values with predetermined target values. The track grid is lifted and laterally aligned by means of a lifting and lining device for such a time until the difference between the predetermined target position and the actual position is zero. This geometric position is fixed by compacting the ballast beneath the sleepers to the left and the right of the tracks by means of a tamping unit. The lifting and lining of the track grid occurs via respective hydraulic lifting and lining cylinders with proportional or servo control. Switches comprise a continuous track and a diverging track as a special feature. A change in the direction of movement of the train is produced via the so-called switch blades. The crossing region between the continuous track and the diverging track is known as the cross frog. Switch tamping machines with divided tamping units, i.e. split-head tamping units, are especially provided for tamping switches. During the tamping of a switch, the respective outer unit of one side can be pivoted upwardly in the direction of the diverging set of tracks for tamping the same.

EP 0 386 398 B1 illustrates an embodiment of a transverse displacement device for tamping units on a sliding guide which is common to the tamping units and which is characterized by a limited transverse displacement path within the machine frame. The common transverse guide in a plane parallel to the track plane is characterized by low flexural rigidity because the guides are disposed horizontally to the track plane. The rotary device is formed by four guide rollers which are twistable about vertical axes, wherein the centring occurs via a guide surface of the machine frame which is formed in the manner of a circular segment. EP 1 845 616 B1 shows an embodiment of the transverse displacement device, which illustrates four units which are transversely displaceable on a further rotatable intermediate frame, which on its part comprises an additional transverse displacement so that a greater transverse displacement path can be achieved at least for the respectively outer unit. The path of displacement of the respectively inner units remains limited. The vertically limited flexural rigidity of the units thus guided in this manner leads to an oscillating behaviour during tamping as a result of the immersing forces, which leads to an increased permanent bending stress fatigue limit. The rotary apparatuses designed up until now are complex in their configuration and require an increased amount of maintenance. The limitation of the transverse displacement path of the inner unit of one side and the limited displacement paths in general prevent the tamping of a switch (main track and diverging track) in one operation. The prior art requires two operations for tamping a switch. Tracks that are tamped properly need to be tamped to the left and the right of the track. The main track is therefore tamped in the first operation and only the inner region of the outer track of the switch is tamped in the diverging track of the switch. Such regions are tamped in a second operation which could not be processed in the first operation. Embodiments are also known in which the outer unit part is situated on an outwardly pivotable support. In order to ensure that the unit position can be adjusted to the obliquely disposed longitudinal sleepers in the switch, it is necessary that the said support arm needs to be implemented in a longitudinally displaceable manner. The unit which is situated on the support arm must further be formed in a rotatable manner on said support arm. Such embodiments are mechanically complex and lead to vibrations of the unit during immersion and tamping.

SUMMARY OF THE INVENTION

The invention is thus based on the object of providing a transverse displacement device for units which allows independent displacement of both respective units of one machine side to such an extent that the main track and the diverging track of a switch can preferably be tamped in one single operation. The rigidity of the guidance of the units in the longitudinal direction of the track, in the vertical direction and furthermore the torsional stiffness shall be increased. According to an advantageous further development of the invention, an adjustment of the tamping units to the obliquely disposed longitudinal sleepers of a switch shall be possible.

This object is achieved by the invention in such a way that both tamping units of each side of the tamping machine are associated with at least two guides, in particular motion bars or sliding tubes, which are offset in relation to each other with respect to their height position and in the longitudinal direction of the tamping machine, wherein the respective outer tamping unit and its associated guides can be displaced transversely to the longitudinal direction of the tamping machine using an adjusting drive, and wherein the inner tamping unit can be displaced on the same guides, independently of the outer tamping unit, transversely to the longitudinal direction of the tamping machine using an adjusting drive. This embodiment in accordance with the invention provides a substantially higher vertical stiffness, stiffness in the longitudinal direction of the track and torsional stiffness. Furthermore, the transverse displacement device allows an independent displacement of the two respective units of one machine side to the extent that the main track and the diverging track of a switch can be tamped jointly. The inner tamping unit is therefore displaceable on the associated guide of the outer tamping unit. Both tamping units can be displaced both jointly and also separately.

A live ring is optionally attached to a support between the lateral main supports of the machine frame of the tamping machine, which live ring can be associated with a guide receiver.

The guides, especially the motion bars or sliding tubes, are mounted in said guide receiver, with which the lateral outer unit parts are rigidly connected. The respective inner unit parts slide on said common motion bars or sliding tubes. The movements are carried out via transverse displacement drives. As a result of this embodiment in accordance with the invention, the respective lateral inner unit can be displaced transversely up to the boundary by the respective lateral outer unit. The motion bars or sliding tubes of the left or right units are arranged spatially independently with respect to each other in accordance with the invention in such a way that they do not obstruct each other and that the at least two guides are provided in an offset manner with respect to each other not only in the longitudinal direction of the tamping machine but also vertically with respect to height.

The unit frames of the tamping units preferably comprise clearances, especially holes, for the guides of the tamping units of the respective other tamping machine sides in order to thus utilise the permissible clear space of the railway tracks in the best possible way. Considerably longer transverse adjusting paths can be achieved by this embodiment.

Such tamping machines are used for setting and tamping a track. The tamping units of both machine sides can be displaced by a transverse displacement device beyond the machine frame to the outside. As a result, it is thus possible at a switch position to completely tamp both the main track and also the diverging track in one operation up to approximately the height of the cross frog. The transverse displacement device with the units that are transversely displaceable is further formed to be rotatable about the upright axis by a live ring. High stability of the guided units is achieved by the at least two sliding guides which are offset in height in relation to the track plane.

It is advantageous in this embodiment in accordance with the invention that greater transverse displacement paths can be achieved for the two units of one side by the transverse displacement apparatus. It is further advantageous that the inner unit of one side can be pushed out up to the boundary by the outer unit of the same side, which is why it is possible to process both the main track and also the diverging track in a switch in one operation. The formation of height-offset sliding guides advantageously leads to a higher stiffness of the apparatus for the protruding tamping units. The use of a live ring apparatus in accordance with the invention further increases the rotational range of the entire apparatus and offers lower need for maintenance and lower costs as a result of the simple configuration.

BRIEF DESCRIPTION OF THE DRAWINGS

The subject matter of the invention is schematically shown in the drawings, wherein:

FIG. 1 shows a track-driveable tamping machine with a rotary and a transverse displacement device of the units, the tamping units per se and the lifting and lining device in a side view;

FIG. 4 shows a constructional variant of a unit frame of a tamping unit in a side view;

DESCRIPTION OF THE PREFERRED EMBODIMENTS

Figure 2:
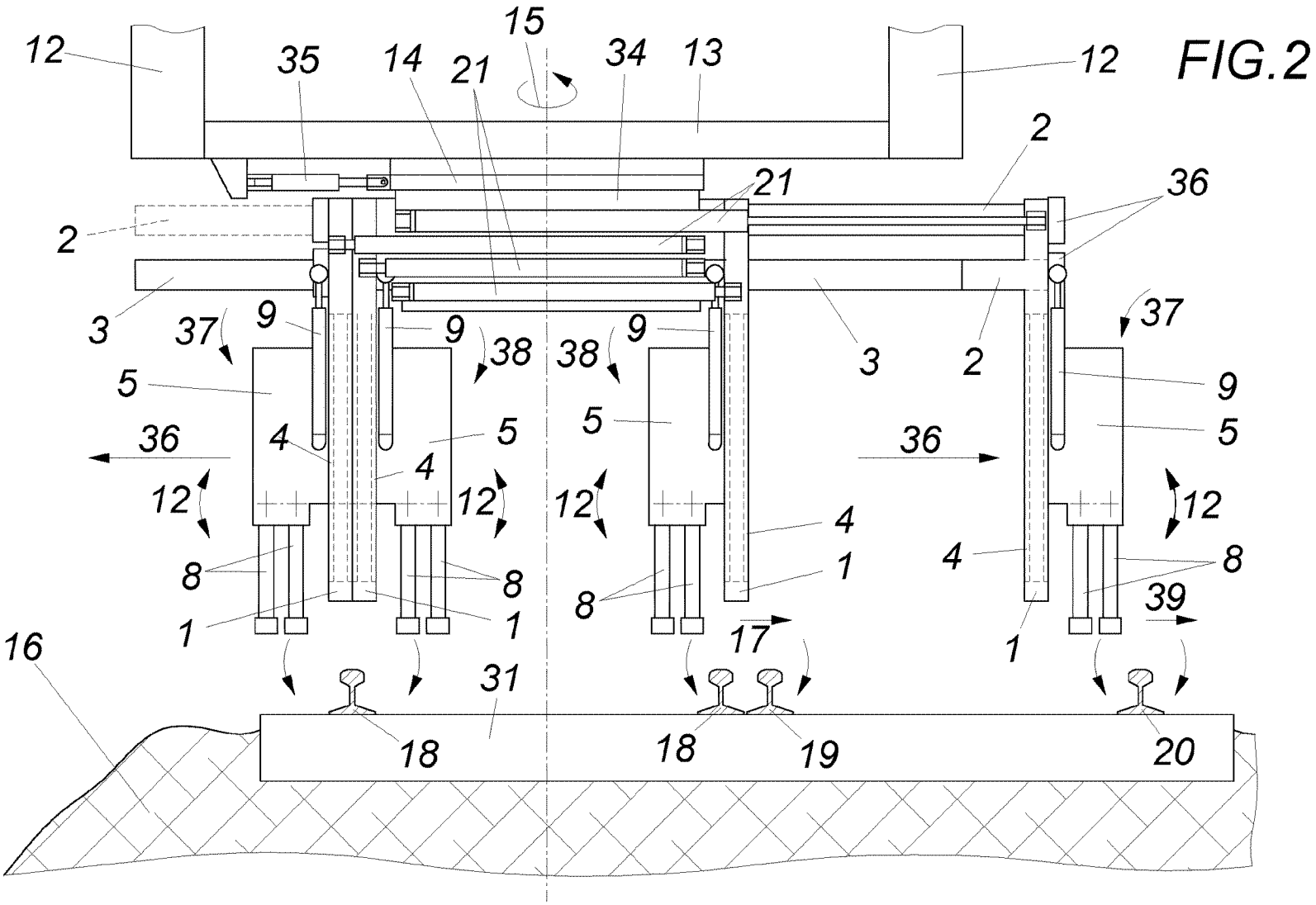
FIG. 2 shows the tamping units in accordance with the invention with rotary and transverse displacement devices in a front view.

A tamping machine 22 (FIG. 1) with main supports 12 comprises tamping units 41 with a transverse displacement device 1, a lifting and lining unit 26 and a track lifting drive 25 as well as a track lining drive 33. Reference numeral 31 shows the conventional diesel engine which is used as a power source. 23 and 24 show the driver's cabins, 29 the operator's cabin. The machine 22 travels via the undercarriages 28 on the tracks 30, which are fastened on their part to the sleepers 31 to be tamped. The sleepers 31 are tamped by the tamping tines 8, which enter the ballast during the operation. The direction of work is indicated by reference numeral 32. The actual position of the track is recorded by the measuring carriage 27 and a measuring device, and the track is lifted, lined and fixed in this position by tamping by comparison with the track target position of the track. The tamping units are set up in their position in parallel to the longitudinal sleepers disposed obliquely in the switch by means of the rotary apparatus 14.

A live ring 14 is fastened to the crossbeams 13 attached to the lateral main supports 12 (see FIG. 2) of the tamping machine 22. The entire transverse guide device can be rotated by means of said live ring 14 about the upright axis (by at least 20°) by means of the rotary drive 35. A transverse guide receiver 34 is mounted on the bottom side of the live ring 14. The motion bars or sliding tubes 2 and 3 move in a sliding manner in the transverse guide receiver 34. The motion bars or sliding tubes 2, 3 are rigidly connected to the respective outer unit 37. The inner units 38 move freely within the region 36 on the motion bars or sliding tubes 2, 3, only limited by the respective outer unit 37 and the limit stop on the inside of the transverse guide receiver 34. The units 37, 38 are transversely displaced by the transverse drives 21. Guide rods 4 for the vertical guidance of the unit boxes 5 are provided in the unit frames 1. The units 37, 38 are lifted and lowered by vertical drives 9. The working tools, which are the so-called tines 8, can be pivoted upwardly and downwardly 12. As a result of the transverse displacement, the inner unit of the right side can tamp the inner side to the left of the rail 18 first and subsequently also tamp the outer side, situated adjacent to the rail 19, by transverse displacement 17 to the outside. It is possible to proceed similarly with the outer unit concerning the tamping of the outer rail 20 of the diverging track by transverse displacement about 39. As a result, a switch position can be tamped in its entirety without displacing the tamping machine 22.

Figure 3:
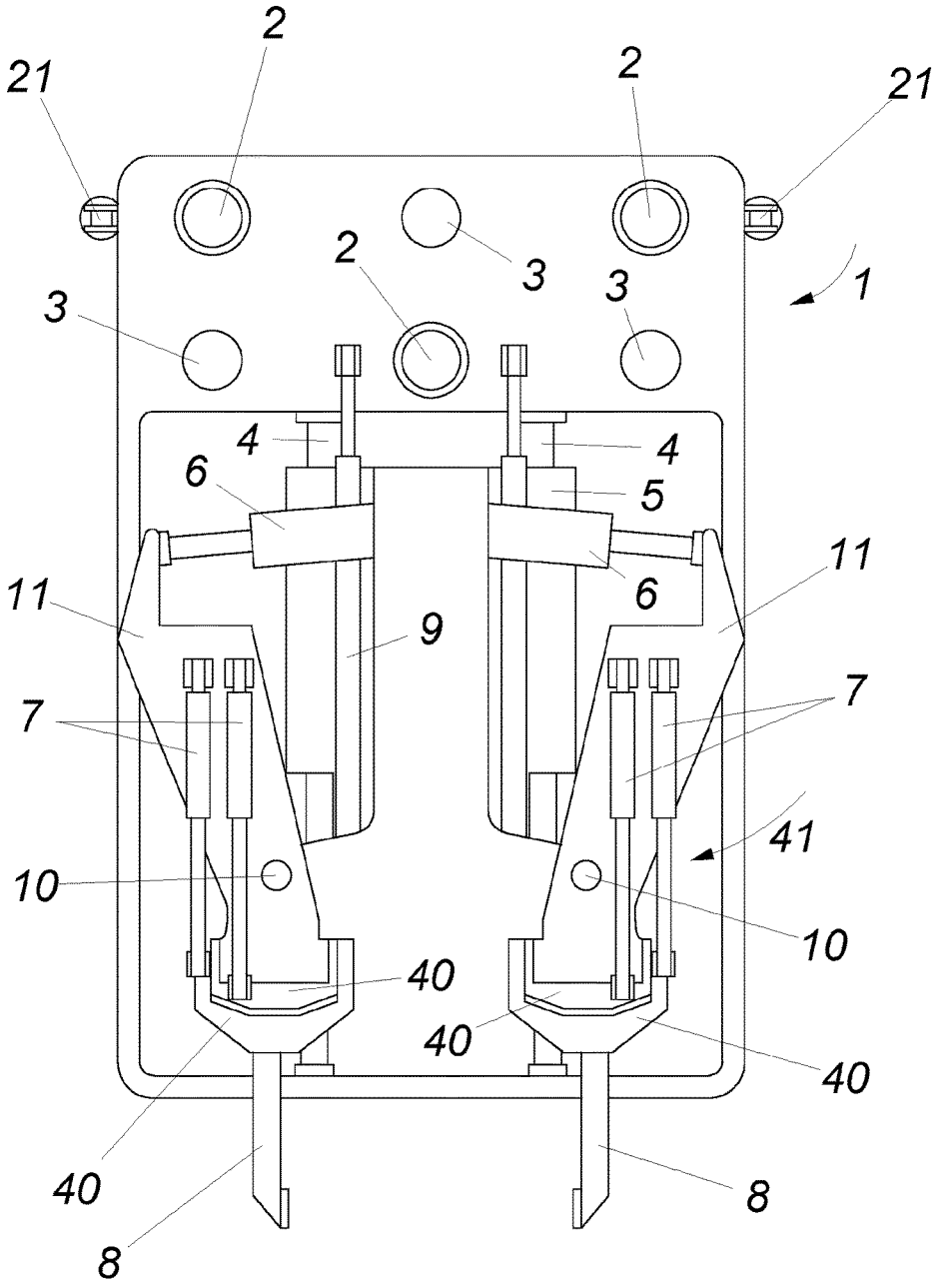
FIG. 3 shows a unit frame of a tamping unit in a side view.

FIG. 3 schematically shows the outer unit frame 1 with the tamping unit 41 in a side view. The tamping arms 11 are twisted about the point 10 via the adjusting cylinders 6 and the ballast is compacted in this process. The working tools, i.e. the so-called tamping tines 8, can be laterally pivoted via the tamping tine holders 40. The tamping unit 41 is lifted and lowered by means of the guides 4 via the lifting-lowering cylinder 9. The unit box 5 runs in the guides 4. Reference numeral 21 shows the two transverse displacement drives of the unit frame 1. Reference numeral 2 represents the fixed connection of the outer unit frame 1 with the motion bars or sliding tubes. Reference numeral 3 represents boreholes in the outer unit frame 1 through which the motion bars or sliding tubes protrude for the two tamping units of the opposite side. In the retracted state, the motion bars or sliding tubes for the opposite tamping units protrude from the boreholes 3. This allows the great transverse displacement path by utilising the entire permissible clearance profile. The illustrated arrangement in the triangle of the guide rods or guide tubes 2 produces a very high stiffness of the unit frame 1 against vertical, transverse and torsional movements.

FIG. 4 shows an embodiment of the unit frame 1 with only two guide rods or guide tubes. Reference numeral 4 shows the arrangement of the vertical guide for the tamping unit. Reference numeral 3 shows the boreholes in the unit frame for the guide rods or guide tubes of the opposite units.

Figure 5:
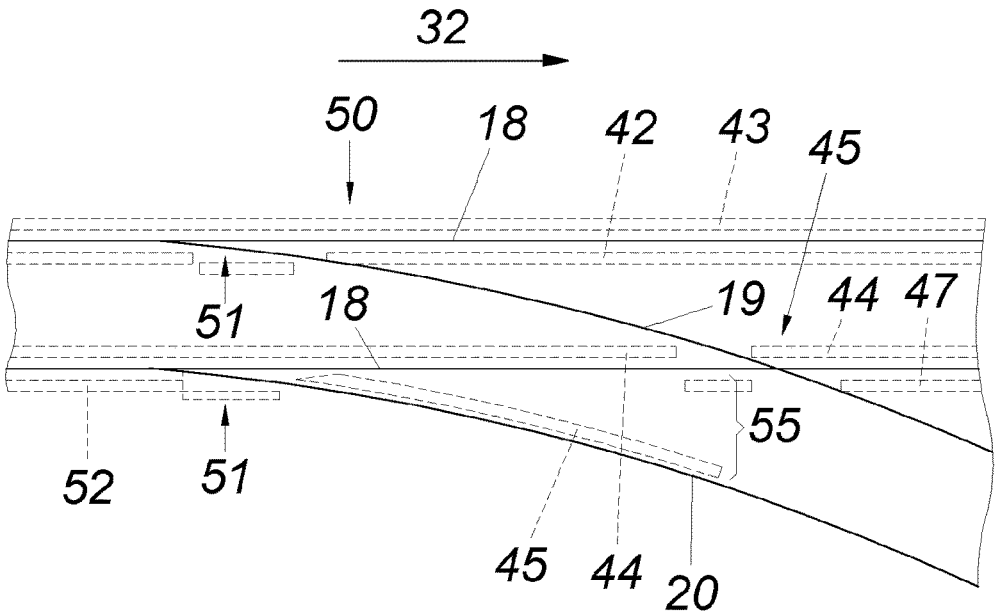
FIG. 5 shows a view of the tamping units of the first operation in a switch.

FIG. 5 schematically shows the usual complete tamping of a switch 50 in a first operation. The working direction is indicated by reference numeral 32. The inner and the outer unit of the left side in the working direction tamp the track to the left 43 and to the right 42 adjacent to the rail 18 on the field side. Up until the region of the switch blade 51, the track of the right rail is tamped by the inner and outer unit to the left 44 and to the right 52 of the rail 18 of the continuous track. After the switch blade region 51, the continuous track is tamped on the inside 44 by the inner right tamping unit. The outer right unit is pivoted outwardly and tamps the inner side 45 of the diverging track 20 until the transverse displacement reaches its limit 55. The outer unit then pivots back and tamps the outer region 47 of the continuous track 18.

Figure 6:
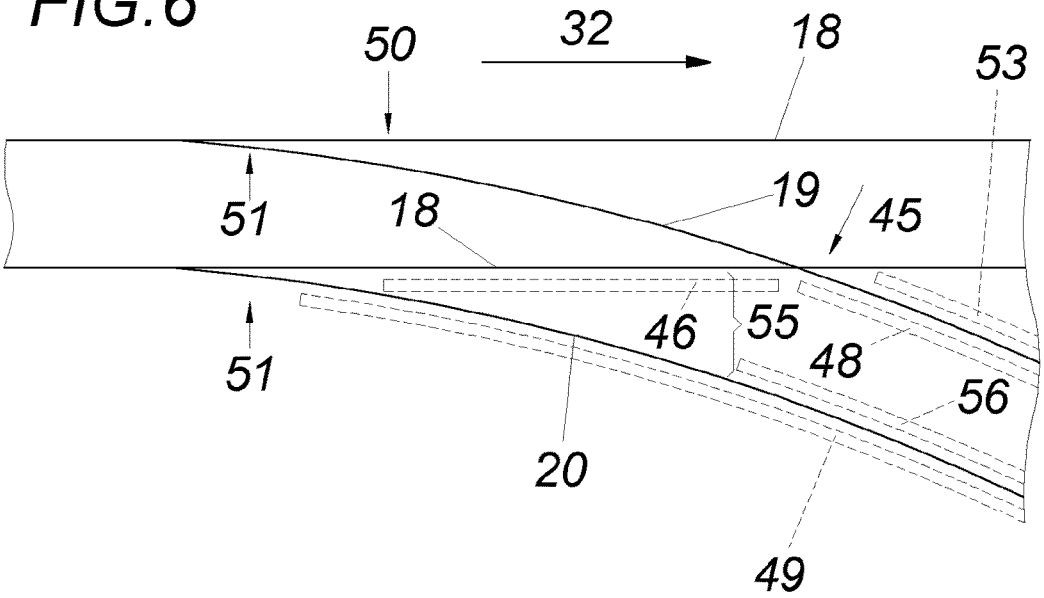
FIG. 6 shows a view of the tamping units of the second operation in a switch.

FIG. 6 schematically shows the second operation of the complete tamping of a switch 50. The working direction is indicated by reference numeral 32. The two left units are not in use up to the cross frog. The inner unit of the right side now tamps the outer region 46 of the continuous track 18 up to the cross frog 54. It then tamps the inner side 56 of the rail 20 on the outer curve of the diverging track 56. The units of the left side are used again from the cross frog and tamp the outer region 53 and the inner region 48 of the rail 19 on the inner curve of the diverging track. The outer unit of the right side tamps the outer region 49 of the outer rail 20 of the diverging track. The inner unit of the right side commences the tamping of the inner side of the rail 56 on the track on the outer curve from the region 55 up to which tamping was possible in the first operation. With the embodiment of the transverse displacement device in accordance with the invention and the resulting great pivoting range of both units of one side, it is possible to carry out the complete tamping of a track in one operation by respective pivoting movements of the right units and successive tamping up to the cross frog region. The stability of the geometric position of the switch is thus increased.

The invention claimed is:

1. A tamping machine for compacting the ballast bed of a track, said tamping machine comprising:

at least two respective tamping units for each side of the tamping machine, wherein said units can each be displaced transversely relative to a longitudinal direction of the tamping machine, and a lifting and lining device, said lifting and lining device being arranged between on-track undercarriages in a working direction, and wherein the two tamping units of each side of the tamping machine are associated with at least two guides that are offset in relation to each other with respect to a height position thereof and in the longitudinal direction of the tamping machine so as to be inner and outer tamping units, wherein the outer tamping unit and the associated guides thereof can be displaced transversely to the longitudinal direction of the tamping machine using an adjusting drive, and wherein the inner tamping unit can be displaced on the same guides, independently of the outer tamping unit, transversely to the longitudinal direction of the tamping machine using a second adjusting drive.

2. A tamping machine according to claim 1, wherein the guides of the tamping units of the two tamping machine sides have positions so as to be arranged in an offset manner in relation to each other.

3. A tamping machine according to claim 1, wherein the guides of the tamping units of opposite tamping machine sides rest in a common guide receiver.

4. A tamping machine according to claim 1, wherein the tamping units have unit frames that have clearances for the guides of the tamping units of the respective other tamping machine sides.

5. A tamping machine according to claim 1, wherein the two tamping units of each side have three guides associated therewith, and are offset in relation to each other with respect to height thereof and in the longitudinal direction of the tamping machine.

6. A tamping machine according to claim 1, wherein a guide receiver is mounted for rotary displacement about an upright axis of the tamping machine in a rotary bearing associated with the tamping machine.

7. A tamping machine according to claim 6, wherein the guide receiver is fastened to a live ring so as to provide rotary displacement about an upright axis of the tamping machine, wherein said live ring is mounted in a rotatably adjustable manner with a rotary drive on a support.

8. A tamping machine according to claim 1, and the lifting and lining device includes components operable with a diverging track of a switch.

9. A tamping machine according to claim 1, and said lifting and lining device being arranged in front of the tamping units.

10. A tamping machine according to claim 1, wherein the two guides are motion bars or sliding tubes.

11. A tamping machine according to claim 2, and the guides of the tamping units of the two tamping machine sides are arranged in a staggered manner in relation to each other.

12. A tamping machine according to claim 4, and the unit frames have holes therein providing the clearances for the guides of the tamping units of the respective other tamping machine sides.

13. A tamping machine according to claim 5, and the three guides comprising motion bars or sliding tubes.

* * * * *